United States Patent [19]

Sauermilch

[11] 4,343,423

[45] Aug. 10, 1982

[54] MACHINE WITH FINGER PROTECTION GUARD

[75] Inventor: Otto Sauermilch, Stolberg, Fed. Rep. of Germany

[73] Assignee: William Prym-Werke KG, Stolberg, Fed. Rep. of Germany

[21] Appl. No.: 136,966

[22] Filed: Apr. 3, 1980

[51] Int. Cl.[3] ..... B21J 15/28

[52] U.S. Cl. ..... 227/1; 227/61; 227/124; 227/8

[58] Field of Search ..... 227/1, 8, 51, 53, 55, 227/56, 61, 62, 124, 142, 151, 154, 155; 266/76

[56] References Cited

U.S. PATENT DOCUMENTS

| | | | |
|---|---|---|---|
| 2,199,286 | 4/1940 | Fischer | 227/1 |
| 4,013,277 | 3/1977 | Schmitt | 266/76 |
| 4,052,040 | 10/1977 | Ogden | 266/76 X |

FOREIGN PATENT DOCUMENTS

| | | | |
|---|---|---|---|
| 2556516 | 6/1977 | Fed. Rep. of Germany | 227/1 |
| 546098 | 6/1942 | United Kingdom | 266/76 |

*Primary Examiner*—Paul A. Bell

*Attorney, Agent, or Firm*—Michael J. Striker

[57] ABSTRACT

A machine for affixing e.g. snap fasteners, rivets and the like to workpieces has a stationary lower tool and a downwardly movable cooperating upper tool. To protect the finger of an operator against injury by the tools the machine also has a finger guard positioned to move ahead of the descending upper tool. The finger guard is mounted on two parallel upright links which are longitudinally shiftable relative to each other. When the finger guard encounters an obstacle this results in shifting of one link relative to the other and two normally engaged contacts in an electrical circuit for the machine drive move apart, interrupting the circuit and shutting down the machine drive.

4 Claims, 7 Drawing Figures

29
26
4
14
11

28
19
36
18
31
32
25
17
12
15
37
34
13
35
9
8
33

30
29
27
28
35
24
26
36
21
18
20
19
22
23
25
17
16
12
15
37
34
13
33
4
14
11

MACHINE WITH FINGER PROTECTION GUARD

BACKGROUND OF THE INVENTION

This invention relates to a machine with a finger guard.

More particularly, the invention relates to a machine in which two tools cooperate with one another and a finger guard is provided to protect the fingers of an operator against injury upon relative movement of the tools to their working position.

A machine of this general type—used for securing snap fasteners, eyelets, rivets or the like to textiles or other workpieces—is known from German Allowed Application DE-AS No. 2,556,516 to which reference may be had for further details. Because of the particular construction of that machine the main drive shaft must be rearwardly spaced by a relatively substantial distance from the plunger which mounts the upper one of the two tools for movement in an upright path. The front-to-back dimension of this machine is therefore relatively large, whereas it would be desirable to have the machine require less space, especially if it is to be mounted on a free-standing support.

Furthermore, the construction of the machine known from the prior art is such that under certain circumstances, especially when thick padded workpieces are being operated upon, the machine drive can be shut down by the finger guard arrangement even after the arrangement has determined that no obstacles (e.g. the fingers of an operator) are located in the prescribed safety space. A machine shut-down under these conditions is, of course, not necessary.

SUMMARY OF THE INVENTION

It is a general object of the present invention to avoid the disadvantage of the prior art.

A more specific object of the invention is to provide a machine of the type under discussion, in which the aforementioned drawbacks are overcome.

Still another object is to provide such a machine which is shallower from front to back than the prior-art machine.

A concomitant object is to provide a machine of the type under discussion wherein deactivation of the machine drive is prevented when the safety arrangement has determined that there is no danger to the fingers of an operator.

Pursuant to these objects, and to still others which will become apparent hereafter, an aspect of the invention resides in a combination comprising an electrically energized machine drive; a workpiece support mounting the stationary known tool; a plunger mounting the movable upper tool and being vertically movable towards and away from the support, the plunger being driven by the machine drive; a finger guard; means mounting the finger guard for movement ahead of the plunger toward the support, the means including a pair of links parallel to one another and to the plunger, the links being normally in a first relative position and being relatively shiftable to a second relative position in response to the finger guard encountering an obstacle; and circuit means, including a pair of normally abutting contacts on the respective links, the contacts moving apart from one another to interrupt the circuit means and stop the machine drive in response to relative displacement of the links.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
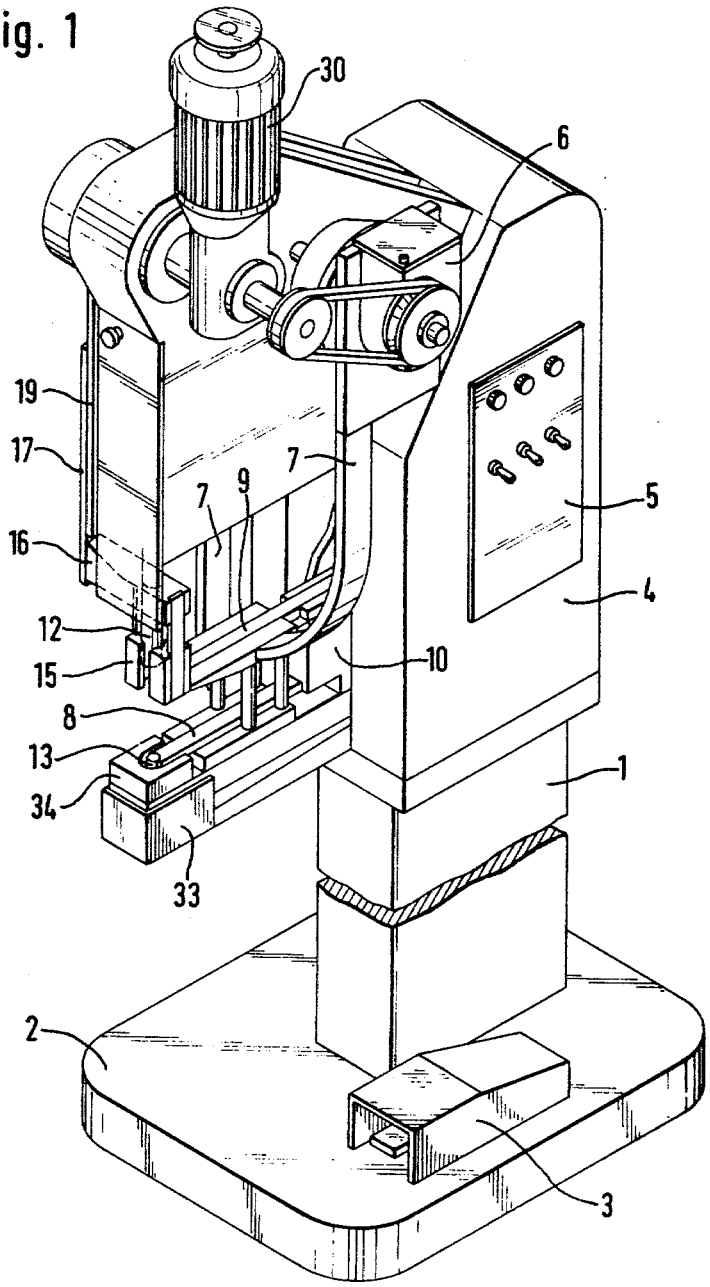
FIG. 1 is a front perspective view of a machine embodying the invention.
Figures 2, 3, 4:
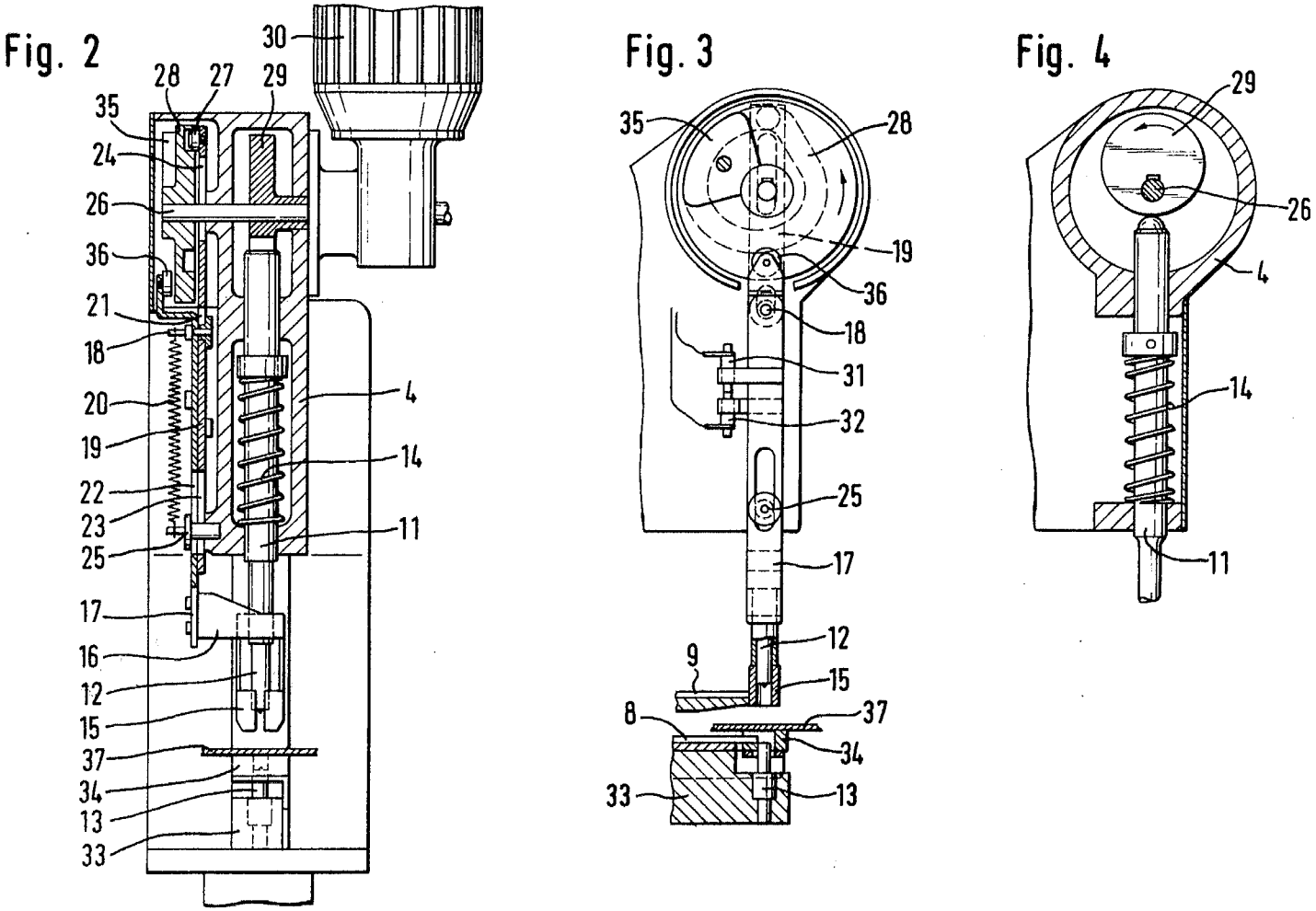
FIG. 2 is a front detail view, partly in section, showing elements of the invention.
FIG. 3 is a side view of the detail in FIG. 2, showing the finger guard in section and in raised position.
FIG. 4 is a side view of the upper part of FIG. 3, with the drive for the upper tool shown in section.

One embodiment of the invention is illustrated by way of example in FIGS. 1–7. The machine has a stand or support 1 on which the machine body 4 is mounted at a height convenient for an operator. The stand 1 includes a base plate 2 on which a foot-operated switch 3 is mounted, which serves to control the drive 30 via control means (not shown, but known per se) arranged at the control panel 5. Magazines 6 are mounted laterally of the body 4 and have guide rails via which the parts e.g. rivets or the like in the magazines and to be secured to the workpieces are fed to the inserting tools 8 and 9 of a slide 10. The tools 8, 9 receive the parts and move them to the required operating position.

The machine has two cooperating tools, a lower tool 13 which acts as an anvil and an upper tool 12 which moves downwardly towards the lower tool to cooperate with the same in securing a part to a workpiece. The upper tool 12 is mounted on a vertically movable plunger 11 which is guided in body 4 for movement toward and away from the tool 13; a restoring spring 14 permanently urges the plunger 11 upwardly, into its rest or starting position. The lower tool 13 and a workpiece support 34 are mounted in a cantilevered arm 33; the front part of the arm carries the tools 8, 9 whereas the rear part is constructed as a guide for the movement of slide 10. A finger guard 15 is constructed as a clamp-shaped workpiece holder and surrounds the upper tool 12; it has a portion 16 via which it is connected with the finger-guard drive. The working stroke of plunger 11 is derived from a main drive shaft 26 which in turn is driven by drive 30, via an eccentric which is mounted on shaft 26 for rotation therewith. As thus far described, the machine corresponds to some extent to the one disclosed in the aforementioned DE-AS 2,556,516.

Pursuant to the invention, however, the member 16 of the finger guard 15 is connected with a link 17. This link is in turn so connected with a parallel second link 19 via a guide bolt 18, that when the force of a spring 20 is overcome the link 17 can move upwardly with reference to the link 19 by a distance corresponding to the length of a guidegroove 21 in the link 19. The spring 20 is connected to the bolt 18 of link 17 on the one hand and to a bolt 25 of a stationary machine part on the other hand, it therefore attempts to draw the bolt 18 in direction towards the leading (lower) end of the groove 21, whereby force transmission from link 19 to link 17 is assured. The link 17 has a guide groove 22 and the link 19 has two such guide grooves 23, 24. Via these grooves the links 17 and 19 are guided on the stationary bolt 25 and on the main drive shaft 26, in such a manner that they can be jointly shifted parallel to the plunger 11 towards the lower tool 13.

The free upper end of the link 19 carries a follower roll 27 engaged in a track of a cam 28 which is mounted on shaft 26 for rotation therewith. The eccentric 29 and the cam 28 are so associated with one another that the link 29 moves ahead of the plunger 11 through a certain fraction of a revolution. Link 17 carries an electric contact 31 which cooperates with another electric contact 32 on link 19 to control the drive 30. In the event of a displacement of link 19 relative to link 17 counter to the action of spring 20, which occurs when the free downward movement of finger guard 15 is interrupted by the presence of an obstacle (e.g. the finger of an operator, as in FIG. 6), the two contacts 31, 32 will open the control circuit and cause instant braking of the machine to a standstill.

In addition to the cam 28 the shaft 26 also carries a segmental cam 35 for rotation with the shaft. Cam 35 cooperates with another follower roller mounted at the upper end of link 17. The shape and angular position of cam 35 are so chosen relative to the cam 28—and thus the eccentric 29—that after the finger guard descends to the prescribed safety spacing the cam 35 fixes the link 17 in this lowered position, so as to prevent unintentional machine shutdown in response to counter pressure exerted by thick elastically yieldable workpieces.

Figure 5:
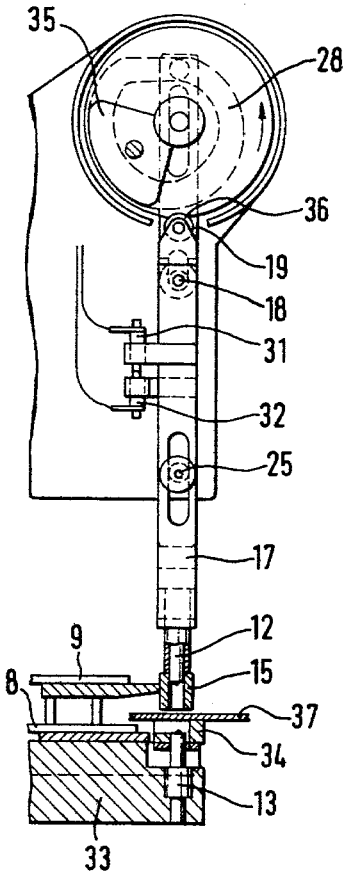
FIG. 5 is a view similar to FIG. 3, but showing the finger guard in lowered position.

The machine operates as follows:

In the position shown in FIGS. 1–4 the machine is either shut down or it is at rest and awaits the emplacement of a workpiece and of components (e.g. snap fastener parts) to be secured to the workpiece. After the workpiece 37 is in place (see FIG. 3) the foot switch 3 is used to energize the drive 30 so that the main shaft 26 starts to rotate. This causes both the finger guard 15 and the plunger 11 to be moved downwardly towards the lower tool 13; because of the differentials in the shape of the eccentric drive 29 and the cam 28 the finger guard is lowered rapidly so as to move ahead of the plunger 11. As FIG. 5 shows, the plunger 11 and upper tool 12 perform only a slight downward movement during the time span required for the finger guard 15 to descend. When the finger guard 15 arrives at its lowest position, the segment 35 has moved into blocking position with the roll 36 of link 17, thereby preventing unintended upwards movement of link 17 and disengagement of the contacts 31, 32 from one another, which would cause the drive 30 to shut down. This blocking position remains until the upper tool 12 has in turn reached its lowest point of travel, i.e. until the working stroke is completed.

Figure 6:
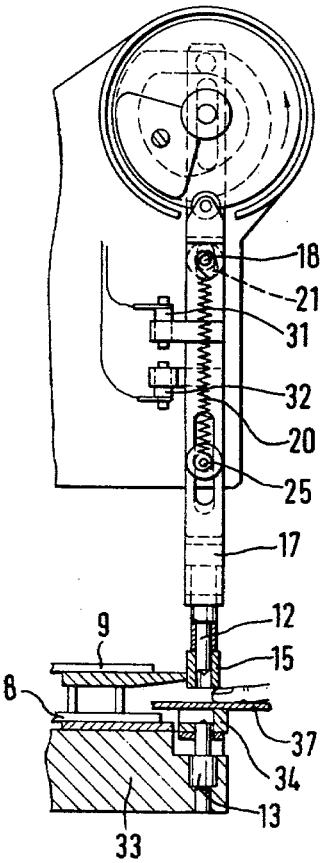
FIG. 6 is another view similar to FIG. 3, but with the finger guard shown triggered, i.e. responding to the presence of an obstacle.
Figure 7:
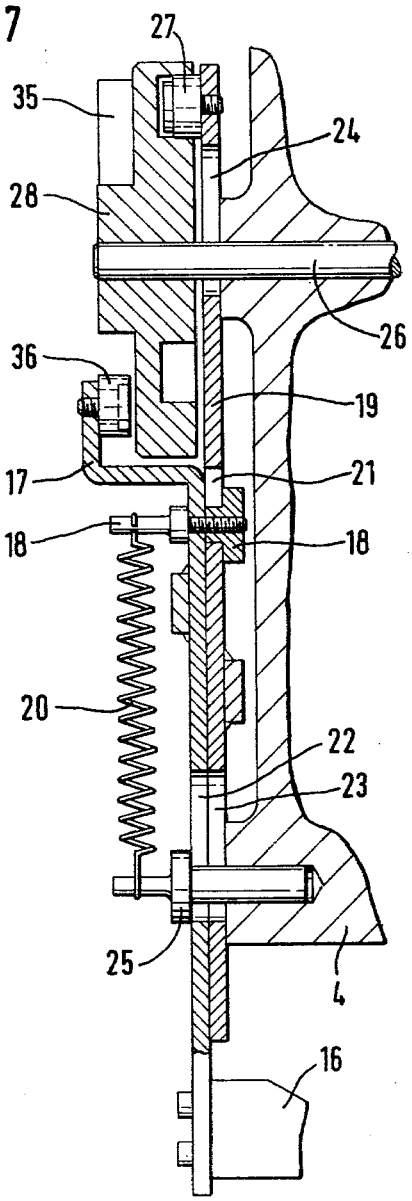
FIG. 7 shows the drive for the finger guard in a sectioned view and on an enlarged scale.

The operation as described thus far assures that if the finger guard encounters any obstacle, such as the finger of an operator, during its descent it leads to the immediate shut-down of the machine. More specifically, if the guard does encounter an obstacle, e.g. a finger as shown in FIG. 6, then the link 17 shifts relative to the link 19 counter to the biasing force of spring 20. It is of course understood that the force of spring 20 is sufficiently weak to assure that all danger of injury to the finger is precluded. The shifting of link 17 relative to link 19 moves the contacts 31, 32 apart from one another and results in shut-down of the machine. It must be noted that at this time the segment 35 can not move into engagement with the link 36 when finger guard 15 encounters an obstacle, due to the immediate shut-down of the machine.

The machine according to the invention can be operated in a single-stroke cycle, i.e. after completion of the working stroke the parts return to the position shown in FIGS. 1–4 and the machine comes to a halt due to shutting-off of the drive 30. It can also, however, be operated continuously, which is to say that everytime a working stroke is completed and the parts return to their position of FIGS. 1–4, a new working stroke is automatically initiated.

While the invention has been illustrated and described as embodied in a machine for affixing snaps, rivets and the like to workpieces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a machine having a stationary lower tool and a vertically movable upper tool, a combination comprising an electrically energized machine drive; a workpiece support mounting the stationary lower tool; a plunger mounting the movable upper tool and being vertically movable towards and away from said support, said plunger being driven by said machine drive; a finger guard; means mounting said finger guard for movement ahead of said plunger toward said support, said means including a first link and a second link extending parallel to one another and to said plunger, said first link and second link being formed with a first slot in a lower portion thereof, a first stationary projection extending into said first slot, said second link having a second slot spaced from said first slot in a direction of said plunger, a second guide projection extending into said second slot, and spring means between said first and second projections, said links being normally moved by said spring means into a first relative position and being relatively shiftable to a second relative position in response to said finger guard encountering an obstacle; and circuit means, including a pair of normally abutting contacts on the respective links, said contacts moving apart from one another to interrupt said circuit means and stop said machine drive in response to relative displacement of said links.

2. A combination as defined in claim 1, and further comprising motion-transmitting means operatively connecting said links with said machine drive.

3. A combination as defined in claim 2, said machine drive comprising a main drive shaft, and said motion-transmitting means comprising a cam on said drive shaft and a roll provided on a free upper end of said second link and tracking said cam.

4. A combination as defined in claim 3, further comprising another roll provided on an upper end of said first link, and a cam segment on said drive shaft rotatable therewith and engageable with said roll on said first link.

* * * * *